United States Patent [19]

Bacon

[11] 4,068,397

[45] Jan. 17, 1978

[54] SNOWBLOWER DISCHARGE GUIDE AND CONTROL ARRANGEMENT THEREFOR

[75] Inventor: Roger J. Bacon, Plymouth, Wis.

[73] Assignee: Gilson Brothers Company, Plymouth, Wis.

[21] Appl. No.: 766,057

[22] Filed: Feb. 2, 1977

[51] Int. Cl.[2] ..... E01H 5/04

[52] U.S. Cl. ..... 37/43 R; 285/272; 302/9; 242/157 R

[58] Field of Search ..... 37/43 R, 43 A, 43 B, 37/43 C, 43 D, 43 E, 43 F, 43 G, 43 H, 43 U, 43 L; 302/9, 10, 38, 59, 60; 242/157; 138/111, 113; 285/272, 278, 282

[56] References Cited

U.S. PATENT DOCUMENTS

| | | | |
|---|---|---|---|
| 2,768,453 | 10/1956 | Adams, Jr. | 37/43 E |
| 3,509,977 | 5/1970 | Bacon | 37/43 R |
| 3,721,025 | 3/1973 | Orr | 37/43 E |
| 3,774,322 | 11/1973 | Enters et al. | 37/43 R |
| 3,805,421 | 4/1974 | Kamlukin | 37/43 D |
| 3,808,715 | 5/1974 | Haban | 37/43 R |
| 3,867,773 | 2/1975 | Gunderson | 37/43 R |
| 3,879,866 | 4/1975 | Gunderson | 285/272 X |
| 4,011,668 | 3/1977 | Gunderson | 37/43 R |

*Primary Examiner*—E. H. Eickholt

[57] ABSTRACT

A discharge guide is mounted on the same base as the snowblower engine. A rotatable flange assembly surrounds an outlet tube in the collector housing and a drive engagement between the rotatable flange assembly and the discharge guide transmits rotary motion therebetween. A flexible cord extends from a control assembly in the snowblower handle along the snowblower frame to the rotatable flange assembly to afford control over turning movement of the discharge guide.

10 Claims, 7 Drawing Figures

SNOWBLOWER DISCHARGE GUIDE AND CONTROL ARRANGEMENT THEREFOR

BACKGROUND OF THE INVENTION

This invention relates to power snowthrowers and, more specifically, to the arrangement of the discharge guide in the snowblower and the manner of producing turning movement of the discharge guide.

Power snowblowers conventionally utilize a discharge guide in association with the collector assembly to control the direction and distance snow is thrown. The discharge guide is generally capable of turning through a preselected arc to discharge snow either to the right or the left of the snowthrower or to any intermediate position, all within the control of the operator.

This invention is directed to the construction and arrangement of the discharge guide and its turning control and has among its general objects the provision of both a discharge chute arrangement and control therefor which are relatively simplified and economical to fabricate and assemble and yet are reliable in overall operation.

SUMMARY OF THE INVENTION

For the achievement of this and other objects this invention proposes an arrangement wherein the discharge guide is supported on a portion of the frame of the snowthrower as opposed to being supported on the collector assembly housing, preferably the discharge guide assembly is mounted on the same frame position as the snowthrower engine. The discharge guide is positioned over the outlet tube of the collector housing and has a driving connection with a flange assembly which is rotatably supported on the outlet tube so that rotatable movement is transmitted therebetween. A flexible cord extends from a discharge guide control located in the handle of the snowthrower to the rotatable flange assembly and is effective to translate control movement of the discharge guide control into rotation of the flange assembly and correspondingly of the discharge guide. This results in controlled turning movement of the discharge guide through its preselected arc of movement to achieve selective discharge either to the right or the left of the snowthrower or any selected point in-between.

In the preferred embodiment the flexible cord is wrapped around and is anchored on a disc supported for rotation in the snowthrower handle. Extensions of the cord project tangentially from diametrically opposite sides of that disc along the handle and the frame of the snowthrower to the rotatable flange assembly. The cord extensions are wrapped around and anchored to the flange assembly so that rotation of the disc in both directions is transmitted directly to the flange assembly and, through the driving connection, to the discharge guide.

Also in the preferred embodiment, the control cord must make a transition from the generally vertical handle to a generally horizontal extension along the base which supports the discharge guide and engine. Preferably, generally Y-shaped cord guides, notched to accommodate the cord extensions, are attached to the frame to provide support and clearance for the cord at the points where the transition from a generally vertical to a generally horizontal extension is made. The Y-shaped configuration stabilizes the guide and its arms provide a smooth path around the transition points.

Other objects and advantages will be pointed out in, or be apparent from, the specification and claims, as will obvious modifications of the embodiment shown in the drawings, in which:

FIG. 1 is a perspective view of a snowthrower;
FIG. 2 is an enlarged side view of the snowthrower;
FIG. 3 is a front view of the discharge guide support;
FIG. 4 is an enlarged view of the discharge guide control;
FIG. 5 is a section view along line 5—5 in FIG. 4;
FIG. 6 is a top view of the flange assembly; and
FIG. 7 is an enlarged view of a cord guide.

DESCRIPTION OF THE PREFERRED EMBODIMENT

Figure 1:
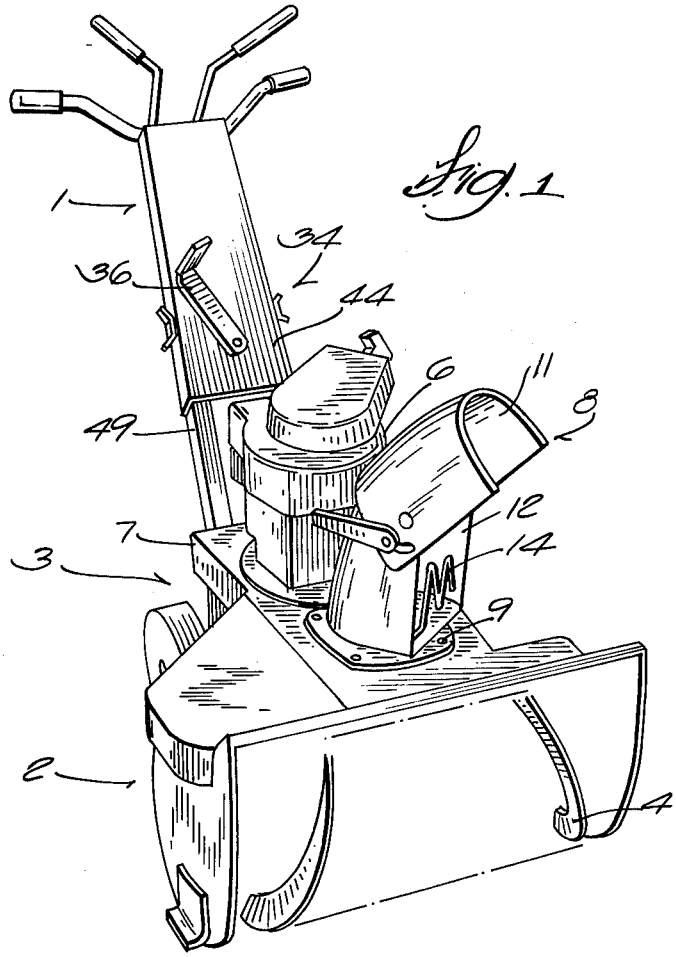

With particular reference to the drawings, a snowthrower is illustrated as including a handle 1, a collector assembly 2 and a support frame 3 extending between the handle and the collector assembly. A collector 4 in the form of an auger, is rotatably supported within housing 2 and is driven by engine 6 through a suitable drive train (not shown). The details of the handle, collector assembly, frame portion and engine as well as the collector drive are not necessary to a complete understanding of this invention and hence will not be described in detail.

Engine 6 is connected to a shroud 7 which is in turn suitably bolted to frame extension 3, the shroud becoming basically a part of the overall frame of the snowblower. Discharge guide 8 is located just forward of engine 6 and is also attached to shroud 7. The discharge guide assembly includes a support flange 9 and a discharge chute formed by an upper deflector 11 and a lower deflector 12.

The details of the collector and traction drive are more particularly disclosed and claimed in the co-pending application of Edward W. Enters and Roger J. Bacon entitled "Drive Arrangement for Snowblower" filed Feb. 2, 1977, Ser. No. 764,823 and assigned to the assignee of this application.

The upper and lower deflectors are connected by nut and bolt assemblies 13 such that deflector 11 is capable of limited arcuate movement relative to deflector 12 about the nut and bolt assemblies and can be fixed in one of a number of selected relative angular positions to adjust the distance snow is thrown. A deflector guard 14 is located within lower deflector 12 to prevent insertion of the operator's hand or entry of other foreign objects.

Lower deflector 12 has a member 17 attached thereto and member 17 is attached to an extension 16. Member 17 projects through a central opening in flange assembly 9 and the extension projects through opening 18 in shroud 7. Member 17 and extension 16 are joined at flanges 15 and 20 which rest on the surface surrounding opening 18. Flange assembly 9 is bolted to shroud 7 at opening 18 holding the deflector captive while leaving it free to turn about a generally vertical axis.

Turning now to the collector assembly 2, a cylindrical tube 19 is provided to the rear of the collector housing and defines a cylindrical, generally vertical passage which communicates with the interior of the collector housing. In a conventional manner, rotation of auger 4 collects snow within the housing and causes it to be discharged vertically through tube 19.

Flange assembly 21 fits around and is rotatably supported around tube 19. The flange assembly includes a lower flange 22 which provides a bearing surface upon which the entire flange assembly turns on surface 23 adjacent tube 19. The flange assembly includes a generally central flange 24 spaced from the first flange 22 and an upper annular surface 26 engaging a lower annular surface 27 on extension 16 of the discharge guide.

Flange assembly 21 is free to rotate about tube 19 and the discharge guide is free to rotate in opening 18. A driving connection 28 is provided between those two members to transmit rotatable motion therebetween. The drive connection consists of a first tab member 29 secured to the flange assembly 21 and having an irregular upper surface 31. A second tab member 32 is attached to extension 16 of the discharge guide and has a surface 33 which is generally complementary to surface 31 of tab member 29. More specifically, tab member 29 is generally U-shaped in cross section having a first leg **29*a*, an indented web portion 29*b* and a second leg 29*c*, shorter than 29*a*. Similarly, tab member 32 is generally U-shaped in cross section having a first leg 32*a*, an indented web portion 32*b* and a second shorter leg portion 32*c*. These U-shaped members, 32** being inverted, interfit one with the other so that their vertical surfaces interengage and provide the driving connection.

With the just described arrangement, it will be appreciated that rotation of flange assembly 21 produces turning movement of discharge guide 8 so that it can be positioned to discharge snow to the right or to the left of the snowthrower or at any intermediate position. This turning movement is achieved by a discharge guide control arrangement now to be described.

The discharge guide control 34 is located approximately in the middle of handle 1. The control includes a lever 36 connected by a bolt 27 and a key bushing 38 to disc 39. Key bushing 38 has a rectangular end which extends through openings 41 and 42 in the lever and disc, respectively. The openings are also rectangular in cross section so that the lever has a driving connection with the disc. Pivotal movement of the lever about the axis defined by bolt 37 will produce corresponding movement of disc 39. A flexible cord, in the preferred embodiment two separate lengths of cord, are anchored on disc 39 and extend along handle 1 to and are anchored at the flange assembly 21. More specifically, a first cord 43 is wrapped approximately one full revolution around disc 39 and extends from the disc along arm 44 of handle 1 and then beneath shroud 7 to flange assembly 21 through suitable cord guides 46 attached to housing 3. The cord makes approximately one full revolution about flange assembly 21 and is anchored by extending through opening 47 and a knot being tied in the end of the cord so that it cannot be withdrawn from the tab. Similarly, cord 48 is wrapped approximately one full revolution around disc 39, but in a direction opposite to cord 43, and extends along arm 49 of handle 1, beneath shroud 7 to flange assembly 21 through guides 46. At the flange assembly it is wrapped around the assembly in an opposite direction from cord 43 and is similarly anchored in an opening 47.

The ends of cords 43 and 48 are anchored at the disc by a cord plate 52 which is attached to disc 39 by screw 53. The ends of cords 43 and 48 are trapped between plate 52 and a surface of the disc and screw 53 is tightened down to clamp the cord ends in position. With this arrangement, pivotal movement of lever 36 will produce rotation of disc 39 and this rotation is transmitted directly to flange assembly 21 which rotates a corresponding amount causing discharge guide 8 to turn to the right or the left depending upon the direction of movement of lever 36.

Figure 5:
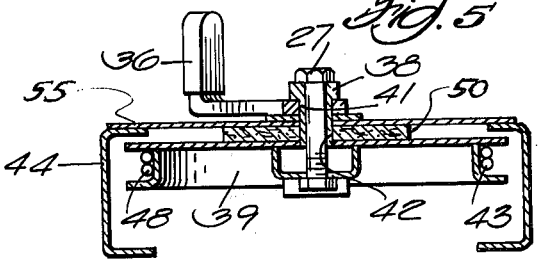
Figure 3:
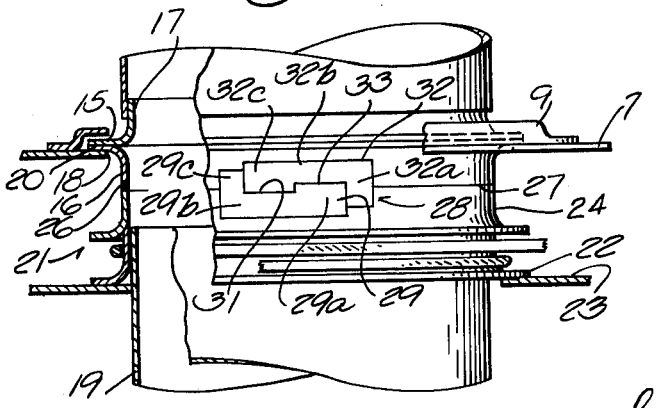
Figure 4:
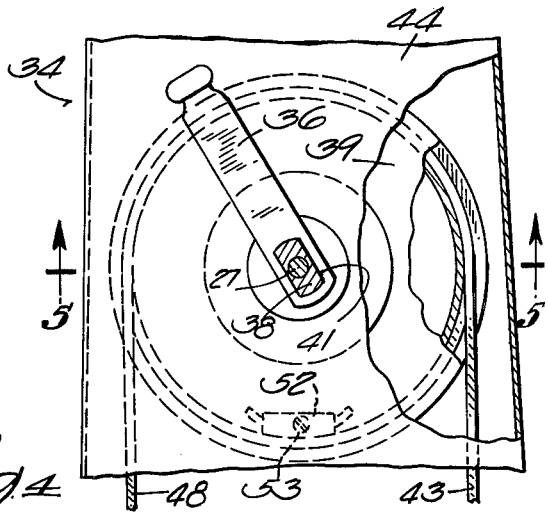
Figures 2, 6, 7:
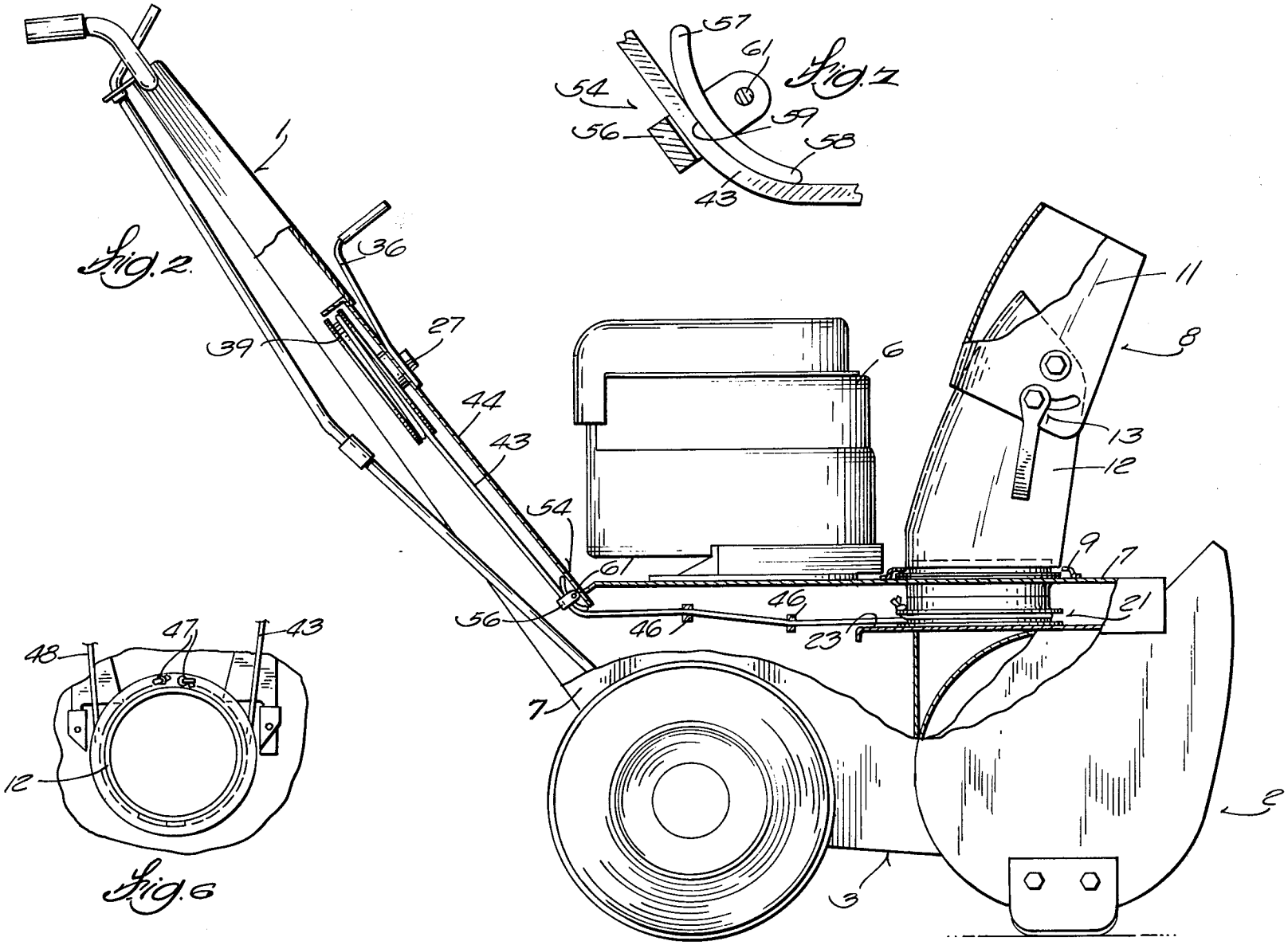

Attention is directed to FIG. 5. A friction pad 50 is sandwiched between disc 39 and the control base 55. When snow is being discharged through the discharge guide reaction forces will result and will tend to displace the discharge guide from a selected position. These forces would be transmitted through the cords and also displace lever 36. Pad 50 exerts a frictional drag on the disc sufficient to prevent movement thereof due to the reaction forces. Since the disc and lever cannot move, neither can the discharge guide so that the pad 50 prevents the reaction forces from displacing the discharge guide from a preselected position. An added advantage of placing the friction at disc 39, as opposed to at the discharge guide is that the force which must be exerted through the cords to move the guide are reduced.

Cords 43 and 48 must make a rather sharp transition from a generally vertical path along arms 44 and 49 to a generally horizontal path under shroud 7. Cord guides 54 at the juncture of the arms with frame 3 capture the cords. The cord guides are generally Y-shaped having a leg 56 and two angularly related, generally arcuate arms 57 and 58. On their inner surface, i.e. inner with respect to their engagement with arms 44 or 49, the guides are notched to a groove 59. The cord is placed in the opening and the guide is put in position against the inner surface of the handle arm and anchored in position with screw 61. The cord is positively held in groove 59, now closed by the handle arm, and arm 49 provides a smooth transition between the vertical and horizontal extensions, it being noted that groove 59 is adjacent to and in line with arms 44 and 49. The construction and arrangement of the cord guides in association with both arms 44 and 49 is identical and therefore only one has been described and identified in the drawings.

Although but one embodiment of the present invention has been illustrated and described, it will be apparent to those skilled in the art that various changes and modifications may be made therein without departing from the spirit of the invention or from the scope of the appended claims.

I claim:

1. A power snowthrower comprising, in combination, a handle, a snow collector assembly including a housing and a snow collector disposed within said housing, a frame assembly connecting said snow collector housing and said handle, an engine, a portion of said frame assembly extending generally horizontal and forming a base and having said engine attached thereto, means defining a generally vertically extending outlet tube in said snow collector housing and communicating with the interior of said housing so that snow collected therein by said collector assembly is directed for discharge through said outlet tube, said base extending over said tube outlet and including means defining an opening which registers generally with said tube outlet, a flange assembly positioned around said tube outlet and supported for rotatable movement relative to said tube outlet, a discharge guide assembly adapted to direct snow passing therethrough laterally of said snowthrower, means attaching said discharge guide to said base at said opening for support of said discharge guide on said base and for rotatable movement of said discharge guide relative to said opening, means defining a driving connection between said discharge guide and said flange assembly, a control lever, means supporting said control lever on said handle for pivotal movement relative to said handle, and flexible cord means extending along said handle and frame assembly from said lever to said flange assembly for transmitting pivotal movement of said lever to said flange assembly so that pivotal movement of said lever is translated into rotational movement of said flange assembly and through said drive connection to said discharge guide.

2. The snowthrower of claim 1 wherein said frame assembly extends horizontally from said handle to and engages said collector housing, said base is generally planar and is attached to said frame assembly and projects over a portion of said collector housing, and said engine is connected to said base between said handle and said discharge guide.

3. The snowthrower of claim 1 wherein said flange assembly is located beneath said base and includes an annular surface directed upwardly toward said base, wherein said discharge guide includes a discharge chute located above said base and including a tubular portion projecting downwardly through said opening and terminating in an annular surface facing toward and engaging said flange assembly annular surface, and said discharge guide also including an anchor portion attached to said base and said discharge chute with the tubular portion of said discharge chute being rotatable relative to said anchor portion.

4. The snowthrower of claim 3 wherein said drive connection includes means defining a member on said discharge guide tubular portion and a member on said flange means, said members interfitting one with the other to transmit rotatable motion therebetween.

5. The snowthrower of claim 4 wherein said interfitting members are generally U-shaped in configuration, one inverted relative to the other and interengaged one with the other to transmit said rotatable motion.

6. The snowthrower of claim 1 including a disc connected to and pivotal with said control lever, said cord means wrapped on said disc and extending from generally diametrically opposed sides of said disc, means guiding said cord means along said handle and frame assembly to said flange assembly, said cord means extending onto said flange assembly at generally diametrically opposed sides thereof and wrapping around said flange assembly, and means anchoring said cord means to said disc and said flange assembly so that pivotal movement of said lever is directed through said cord means to said flange assembly and rotates said flange assembly and said discharge chute.

7. The snowthrower of claim 6 wherein said cord means comprises two separate lengths of cord, one end of each cord anchored to said disc and wrapped around said disc and extending through said guide means to said flange assembly with the opposite ends of each cord anchored to said flange assembly, each cord, relative to the other, wound oppositely on said disc and said flange assembly.

8. The snowthrower of claim 7 wherein said handle comprises laterally spaced arm portions extending in a generally vertical direction, and one of said cords extends along one of said arms and the other of said cords extends along the other of said arms, said cords extending beneath said base and transferring from a generally vertical extension along said handle arms to a generally horizontal extension beneath said base, guide means at the juncture of said handle arms and said base and the point of transition from vertical to horizontal to support said cords at said point of transition, said guide means having a generally arcuate arm engaging a respective one of said cords to guide said cord through said juncture and means defining an open groove in said guide means and adjacent said arcuate arm, said cord means being disposed in said groove and said groove being clamped against a surface of said handle to hold said cord captive therein.

9. The snowthrower of claim 6 including friction means engaging said disc and exerting a frictional drag thereon sufficient to withstand reaction forces exerted on said discharge guide assembly due to the discharge of snow therethrough so that said discharge guide will maintain a preselected discharge position.

10. The snowthrower of claim 1 wherein said handle extends in a generally vertical direction and said cord means extends along said handle, wherein said cord means extends from said handle beneath said base, transferring from a generally vertical extension along said handle to a generally horizontal extension beneath said base, and including guide means at the juncture of said handle and said base and the point of transition from vertical to horizontal for said cord means to support said cord means at said point of transition, said guide means having a generally arcuate arm engaging said cord means to guide said cord means through said juncture and means defining an open groove in said guide means and adjacent said arcuate arm said cord means being disposed in said groove and said groove being clamped against a surface of said handle to hold said cord means captive therein.

* * * * *